United States Patent [19]

Akashi

[11] 4,123,828

[45] Nov. 7, 1978

[54] AUTOMATICALLY LOCKING DUAL-TAB SLIDER FOR SLIDE FASTENERS

[75] Inventor: Shunji Akashi, Kurobe, Japan

[73] Assignee: Yoshida Kogyo K.K., Japan

[21] Appl. No.: 833,174

[22] Filed: Sep. 14, 1977

[30] Foreign Application Priority Data

Sep. 20, 1976 [JP] Japan ..... 51-126423

[51] Int. Cl.[2] ..... A44B 19/30

[52] U.S. Cl. ..... 24/205.14 K; 24/205.14 R

[58] Field of Search ..... 24/205.14 K, 205.14 R

[56] References Cited

U.S. PATENT DOCUMENTS

| | | | |
|---|---|---|---|
| 2,405,875 | 8/1946 | Carlile | 24/205.14 K |
| 2,423,210 | 7/1947 | Ulrich | 24/205.14 K |
| 2,502,901 | 4/1950 | Taberlet | 24/205.14 R |
| 2,535,508 | 12/1950 | Natzler | 24/205.14 R |
| 3,038,227 | 6/1962 | Godfrey | 24/205.14 K |

FOREIGN PATENT DOCUMENTS

| | | | |
|---|---|---|---|
| 141,517 | 6/1951 | Australia | 24/205.14 R |
| 1,082,562 | 3/1954 | Fed. Rep. of Germany | 24/205.14 K |
| 1,059,127 | 3/1954 | France | 24/205.14 K |
| 695,571 | 9/1965 | Italy | 24/205.14 K |

*Primary Examiner*—Bernard A. Gelak

*Attorney, Agent, or Firm*—Bucknam and Archer

[57] ABSTRACT

First and second tab-operated members are mounted longitudinally on, and pivotally supported at their front ends directly by, the respective wings of the slider body and are engaged with first and second pull tabs respectively. The first tab-operated member has a locking pawl at its rear end which is spring loaded to project into the guide channel in the slider body. Both first and second tab-operated members have tongues extending from their front ends and loosely received in an offset cross-channel in the neck of the slider body, with the second tab-operated member tongue disposed forwardly of the first tab-operated member tongue for movement into and out of engagement therewith. The locking pawl can be retracted away from the guide channel to unlock the slider upon exertion of a pull on either first or second pull tab.

7 Claims, 7 Drawing Figures

AUTOMATICALLY LOCKING DUAL-TAB SLIDER FOR SLIDE FASTENERS

BACKGROUND OF THE INVENTION

1. Field of the Invention

This invention relates to slide fasteners in general and, in particular, to an automatically locking slider for slide fasteners.

2. Prior Art

An automatically locking, dual-tab slider of conventional type comprises two tab-operated members pivotally mounted on the respective wings or plate members of the slider body by use of separate pivot pins. One of the tab-operated members is complete with a locking pawl which normally projects into the guide channel in the slider body and which retracts away therefrom upon exertion of a pull on the pull tab in direct engagement with the tab-operated member having the locking pawl. In order to cause retraction of the locking pawl upon exertion of a pull on the other pull tab, both tab-operated members are provided with offset tongues which are loosely received in a cross-channel in the neck of the slider body so as to be in overlapping relationship to each other.

One of the objections to this prior art construction of the automatically locking, dual-tab slider resides in the pivot pins employed for pivotally mounting the tab-operated members on the slider body. The use of such pivot pins makes the assemblage of the slider extremely troublesome and time-consuming. Another objection concerns the cross-channel formed through the slider body neck. The proportion of the cross-channel is made so large to permit pivotal motion of the tongues received therein that the neck, as well as the complete slider body, suffers a significant decrease in strength.

SUMMARY OF THE INVENTION

It is an object of this invention to materially simplify the construction, and assemblage, of the automatically locking, dual-tab slider of the type under consideration.

Another object of the invention is to provide an automatically locking, dual-tab slider of improved strength and durability, which will perform its intended functions to the full throughout the useful life of the slide fastener in which the slider is incorporated.

Briefly, the automatically locking, dual-tab slider in accordance with this invention comprises first and second tab-operated members disposed longitudinally on respective wings of the slider body and each having formed at its front end a pivot portion which is supported directly (i.e., without use of pivot pins or any other means) by one of the wings to permit pivotal motion of the tab-operated member in a plane normal to the plane of one of the slider wings.

According to another feature of this invention, the cross-channel in the neck of the slider body is constituted of first and second offset portions loosely receiving the first and the second tab-operated member tongues respectively. It is possible in this manner to minimize of the cross-channel and hence to increase the strength of the slider body.

The above and other objects, features and advantages of this invention and the manner of attaining them will become more apparent, and the invention itself will best be understood, from the following description and the appended claims, taken together with the accompanying drawings showing preferred embodiments of the invention.

DESCRIPTION OF THE PREFERRED EMBODIMENTS

Figure 1:
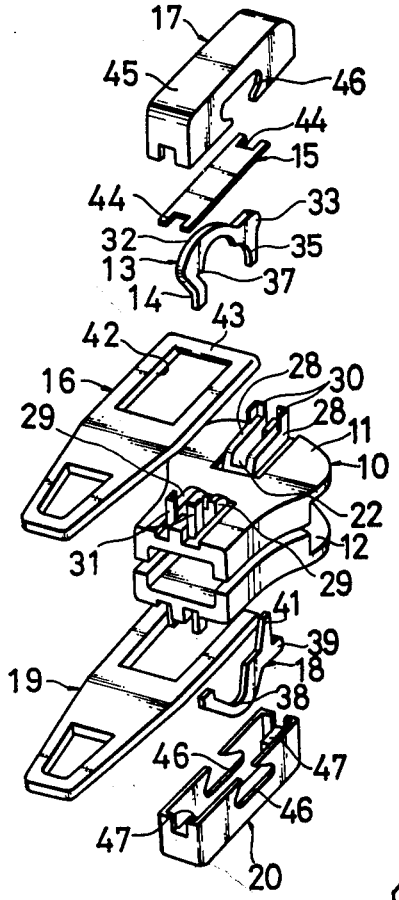
FIG. 1 is an exploded perspective view of the automatically locking, dual-tab slider in accordance with this invention.

Referring to FIG. 1, the automatically locking, dual-tab slider in accordance with this invention includes a body 10 having a first or upper flanged wing or plate member 11 and a second or lower flanged wing 12 which are connected in spaced parallelism. Mounted on the first wing 11 of the slider body 10 are a first tab-operated member 13 including a locking pawl 14 for locking the slider in a desired position on a pair of fastener stringers, a leaf spring 15 for urging the first tab-operated member against the slider body, a first pull tab 16 for unlocking and manipulating the slider, and a first cover 17 for enclosing the first tab-operated member and for supporting the leaf spring.

On the other hand, on the second wing 12 of the slider body 10, there are mounted a second tab-operated member 18, a second pull tab 19 for unlocking the slider via the second tab-operated member and manipulating the slider, and a second cover 20 for enclosing the second tab-operated member. The first and the second tab-operated members 13 and 18, the leaf spring 15, the first and the second pull tabs 16 and 19, and the first and the second covers 17 and 20 are to be assembled with the slider body 10 into the slider shown in FIG. 2.

Figure 3:
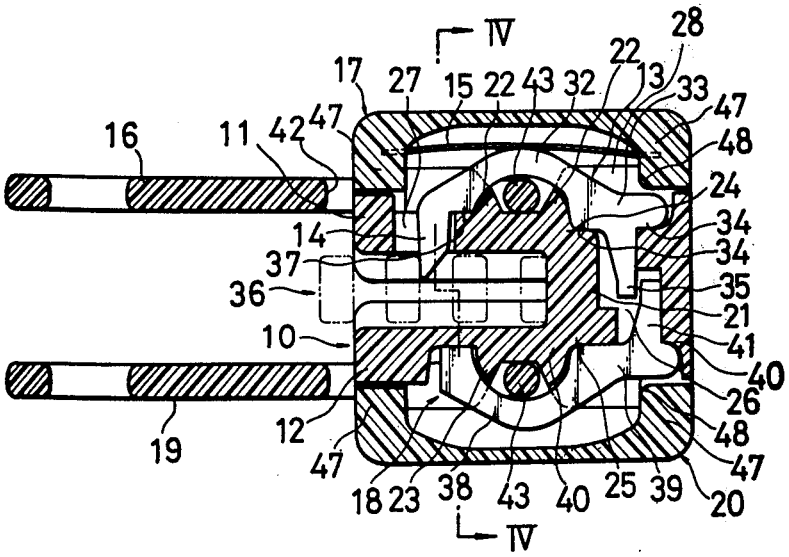
FIG. 3 is an enlarged, longitudinal sectional view taken along line III—III of FIG. 2, showing the slider in its normal or locked condition, with the locking pawl projecting into the guide channel in the slider body.

As shown in FIG. 3, the slider body 10 is an integral plastic molding comprising the first and the second flanged wings 11 and 12 which are connected at their flared front ends by means of a neck 21 to provide the usual Y-shaped guide channel in the slider body. The slider body wings 11 and 12 have pairs of longitudinally spaced-apart lugs 22 and 23 formed on their external surfaces for engaging and pivotally supporting the first and the second pull tabs 16 and 19 in cooperation with the first and the second tab-operated members 13 and 18, respectively.

The slider body wings 11 and 12 have also formed in their external surfaces depressions 24 and 25 which are disposed forwardly of the lug pairs 22 and 23, and these depressions are intercommunicated through an offset cross-channel 26 extending through the slider body neck 21 in a direction generally normal to the planes of the slider body wings. The slider body first wing 11 further has an aperture 27 formed therethrough on the back of the lug pair 22 thereon.

As shown in FIG. 1, two pairs of upstanding walls 28 and 29 are erected on the external surface of the slider body first wing 11, on the front and the rear ends thereof, with each pair of walls extending longitudinally of the slider body with a spacing therebetween. The pair of walls 28 on the front end of the slider body first wing 11 are formed to include L-shaped posts 30 on their front ends, and the other pair of walls 29 are likewise formed to include L-shaped posts 31 on their rear ends. Although not clearly seen in the drawings, similar walls and posts are understood to be formed on the slider body second wing 12, in positions corresponding to the positions of their counterparts on the slider body first wing 11.

With reference to both FIGS. 1 and 3, the first tab-operated member 13 is a sheet metal punching including a C-shaped major portion 32 which is placed longitudinally on the external surface of the slider body first wing 11 so as to extend over the lug pair 22. The front end of the first tab-operated member major portion 32 is shaped into a pivot portion 33 comprising a pair of rounded shoulders 34 which is somewhat loosely fitted in the aforesaid depression 24 in the slider body first wing 11, in such a way that the first tab-operated member 13 is pivotable relative to the slider body in a plane normal to the plane of its first wing. It will be seen that the depression 24 is shaped and sized in accordance with the shape and size of the rounded shoulder pair 34, so as to permit smooth pivotal motion of the first tab-operated member 13.

The first tab-operated member 13 is further formed to include a tongue 35 projecting from the midpoint of its rounded shoulder pair 34. This tongue 35 is loosely received in the cross-channel 26 in the slider body neck 21, as will be later explained in more detail.

Figure 4:
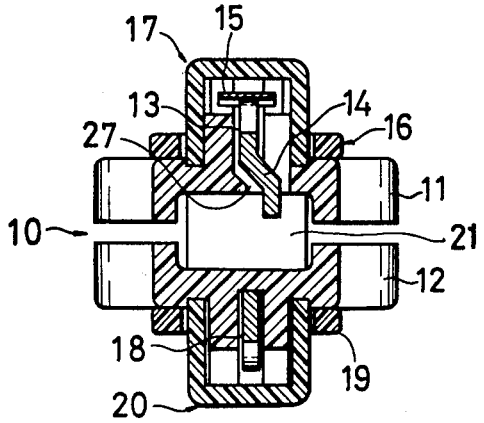
FIG. 4 is a cross sectional view taken along line IV—IV of FIG. 3.

Extending from the rear end of the first tab-operated member major portion 32 is the locking pawl 14 which is received with considerable clearance in the aperture 27 in the slider body first wing 11. Normally, that is, when no pull is exerted on either pull tab 16 or 19, the locking pawl 14 projects out of the aperture 27 into the guide channel in the slider body. As will be seen from FIG. 4, the locking pawl 14 is bent as shown so as to normally engage one of the two rows, chains, or rolls of fastener elements or scoops 36, FIG. 3, of the fastener stringers for use with the slider of this invention. The first tab-operated member 13 further includes a shoulder 37 formed at the rear end of its major portion 32, which shoulder is engageable with the slider body first wing 11 as shown in FIG. 3 to hold the locking pawl 14 in the illustrated normal position.

The second tab-operated member 18, which also is a sheet metal punching, is of substantially identical configuration with the first tab-operated member 13 except that the former lacks a portion corresponding to the locking pawl 14. Thus, the second tab-operated member 18 comprises a C-shaped major portion 38 placed longitudinally on the external surface of the slider body second wing 12 so as to extend over the lug pair 23, a pivot portion 39 including a pair of rounded shoulders 40 fitted in the corresponding depression 25 in the slider body second wing, and a tongue 41 extending from the front end of the major portion and loosely received in the cross-channel 26 in the slider body neck 21 so as to be in overlapping relationship to the first tab-operated member tongue 35.

As shown in FIG. 3, the cross-channel 26 comprises first and second offset portions respectively receiving the tongues 35 and 41 of the first and the second tab-operated members 13 and 18, respectively, with the first cross-channel portion extending from the slider body first wing 11 toward the second wing 12 and the second cross-channel portion extending from the second toward the first wing. It should also be noted that the second tab-operated member tongue 41 is disposed forwardly of the first tab-operated member tongue 35, so as to be movable into and out of engagement with the latter with the pivotal motion of the second tab-operated member 18 about its pivot portion 39. Normally, both tongues 35 and 41 are held in close contact with the respective front walls of the first and the second cross-channel portions as shown in FIG. 3.

As best shown in FIG. 1, the first and the second pull tabs 16 and 19 are plastic moldings of identical configuration. The first pull tab 16, for example, is a somewhat elongate plate member having an opening 42 of rectangular shape located close to one end thereof, which end is shaped into a pivot pin 43 of elliptical cross sectional shape. FIG. 3 shows the first and the second pull tabs 16 and 19 pivotally mounted in position on the first and the second wings 11 and 12 of the slider body 10, with their pivot pins 43 caught between the lug pairs 22 and 23 on the wings and in underlying relationship to the C-shaped major portions 32 and 38 of the first and the second tab-operated members 13 and 18.

In the form of a strip of metal, the leaf spring 15 has a pair of recesses 44 formed in its opposite ends which are to be securely supported by the first cover 17 on the slider body first wing 11. Thus supported by and closed in the first cover 17, the leaf spring 15 is held at its midpoint in contact with the major portion 32 of the first tab-operated member 13 to urge the latter against the slider body first wing 11 and thus to normally hold the locking pawl 14 projecting into the guide channel in the slider body.

The first and the second covers 17 and 20 are also plastic moldings of identical configuration. The first cover 17, for example, is generally box-like, having a closed top 45 and an open bottom as shown in FIG. 1. The opposite side walls of the first cover 17 have recesses 46 for receiving the first pull tab pivot pin 43 with substantial clearance. Each recess 46 increases in width as it extends from the bottom toward the top of the cover. The opposite end walls of the first cover 17 have spring supports 47 projecting inwardly therefrom for engaging and supporting the recessed ends of the leaf spring 15.

Figure 2:
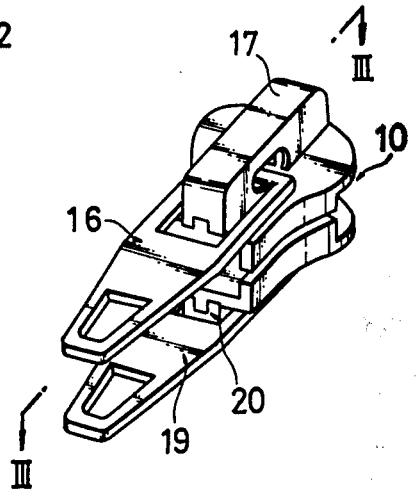
FIG. 2 is a perspective view of the slider of FIG. 1 in assembled form.

FIGS. 2 and 3 show the first and the second covers 17 and 20 mounted in position on the external surfaces of the first and the second wings 11 and 12, respectively, of the slider body 10 by being fitted over the upstanding walls 28 and 29 and the posts 30 and 31 on the wings. It will be noted from FIG. 3 that the front spring supports 47 of the first and the second covers 17 and 20 have rounded corners 48 overhanging the pivot portions 33 and 39 of the first and the second tab-operated members 13 and 18, normally with suitable spacings therebetween.

For assemblying the various slider parts or components of FIG. 1 into the automatically locking, dual-tab slider shown in FIG. 2, the first pull tab 16 may first be placed in position over the slider body first wing 11, with its pivot pin 43 disposed between the pair of lugs 22 thereon. The first tab-operated member 13 is then mounted in position on the slider body first wing 11, by placing its C-shaped major portion 32 astraddle the lug pair 22, by engaging its pivot portion 33 in the depression 24, with the tongue 35 received in the cross-channel 26, and by inserting its locking pawl 14 into and through the aperture 27. The first cover 17 holding the leaf spring 15 is then fitted over the upstanding walls 28 and 29 and the posts 30 and 31 on the slider body first wing 11 and is further secured thereto as by fusion.

The second pull tab 19 and the second tab-operated member 18 are then successively mounted on the slider body second wing 12 in the above described manner, and the second cover 20 is then fused or otherwise secured to the second wing in position thereon. The assemblage of the slider is now completed.

In operation, when a pull is exerted on neither of the first and the second pull tabs 16 and 19, the locking pawl 14 of the first tab-operated member 13 projects into the guide channel in the slider body 10 under the bias of the leaf spring 15 and is engaged between two adjacent ones of the fastener elements 36, thereby locking the slider against movement in such direction that the rows of fastener elements split open along the rows of fastener elements. It is noteworthy that since the first and the second tab-operated member tongues 35 and 41 are normally held in close contact with the offset front walls of the cross-channel 26 in the slider body neck 21, as previously mentioned, the slider can be held stably locked in position on the rows of fastener elements, without the possibility of the tab-operated members 13 and 18 being displaced accidentally from their normal positions.

Figure 5:
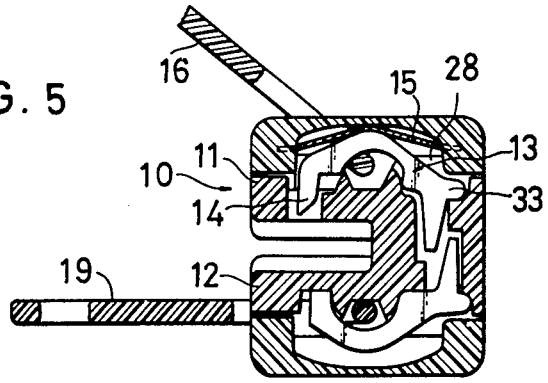
FIG. 5 is a view similar to FIG. 3 but showing the locking pawl retracted away from the guide channel as a result of the exertion of a pull on one of the pull tabs of the slider.

Upon exertion of a pull on the first pull tab 16, with the pull tab held at an angle to the plane of the slider body first wing 11, the first tab-operated member 13 in direct engagement therewith is pivoted clockwise about its pivot portion 33 against the force of the leaf spring 15, as will be seen upon consideration of FIG. 5. The locking pawl 14 at the rear or free end of the first tab-operated member 13 is thus retracted into the aperture 27, out of engagement with the fastener elements 36, so that the slider is now free to move in either direction along the rows of fastener elements as long as the first pull tab is being pulled.

Figure 6:
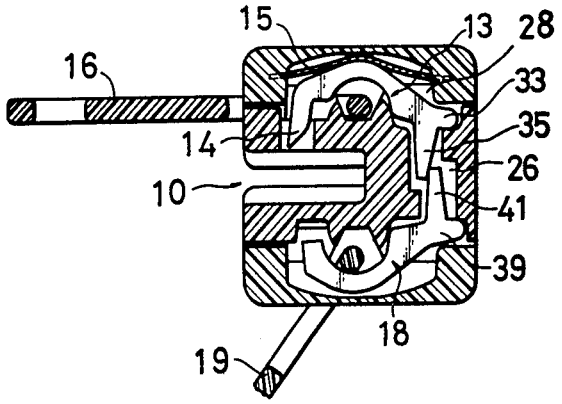
FIG. 6 is also a view similar to FIG. 3 but showing the locking pawl retracted away from the guide channel as a result of the exertion of a pull on the other pull tab of the slider.

Upon exertion of a pull on the second pull tab 19, as shown in FIG. 6, the second tab-operated member 18 in direct engagement therewith is pivoted counterclockwise about its pivot portion 39. The second tab-operated member tongue 41 within the cross-channel 26 is thus moved into engagement with the first tab-operated member tongue 45 and further pushes same rearwardly, thereby causing the first tab-operated member 13 to pivot clockwise about its pivot portion 33 against the force of the leaf spring 15. The locking pawl 14 is thus retracted out of engagement with the fastener elements 36.

Figure 7:
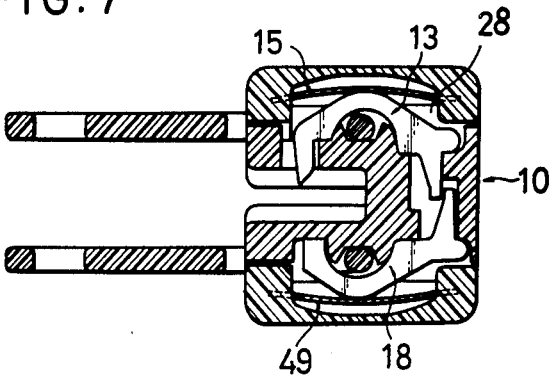
FIG. 7 is also a view similar to FIG. 3 but showing a slight modification of the slider of FIGS. 1 through 6.

FIG. 7 illustrates a slight modification of the above embodiment, wherein another leaf spring 49 similar to the spring 15 is enclosed in and supported at both ends by the second cover 20. This leaf spring 49 is held at its midpoint in contact with the C-shaped major portion 38 of the second tab-operated member 18 for urging same aganst the slider body second wing 12. Upon exertion of a pull on the second pull tab 19, the leaf spring 49 yields to permit pivotal motion of the second tab-operated member 18 in the counterclockwise direction about its pivot portion 39. The leaf spring 49 is effective to maintain the second tab-operated member in the illustrated normal position.

From the foregoing, it should become apparent to the artisan that the invention provides a significant improvement over the prior art which comprises respective round shoulder surfaces 34, 40 on the tab-operated member 13 and 18 and on the slider body itself, which surfaces are positioned for wiping abutting contact to accommodate the pivotal movement of the tab-operated members 13, 18 without connection thereof to the slider body, as was commonly heretofore done by means of pins (not shown).

While particular embodiments of the invention have been shown and described, however, it is to be understood that changes may be made in the construction and arrangements of the various parts without departing from the spirit or scope of the invention as expressed in the following claims.

What is claimed is:

1. An automatically locking, dual-tab slider for slide fasteners comprising:

(a) a body including first and second wings connected at their front ends by a neck so as to provide therebetween a Y-shaped guide channel;

(b) a first tab-operated member including a locking pawl, a first tongue, and a first shoulder having a curved surface in wiping abutting contact with a first shoulder surface of said body so as to permit pivotal motion of said first tab-operated member without connection thereof to the slider body, said locking pawl being movable to project into and to retract away from said guide channel in response to the pivotal motion of said first tab-operated member;

(c) first resilient means for biasing said first tab-operated member against said first wing to cause said locking pawl to normally project into said guide channel;

(d) a second tab-operated member including a second tongue and a second shoulder having a curved surfacee in wiping abutting contact with a second shoulder surface of said body so as to permit pivotal motion of said second tab-operated member without connection thereof to the slider body, said second tongue being movable into and out of engagement with said first tongue in response to the pivotal motion of said second tab-operated member;

(e) said neck provided therein with a cross-channel having first and second offset portions for receiving said first and said second tongues, respectively;

(f) a first pull tab operatively connected to said first tab-operated member for retracting said locking pawl away from said guide channel against the bias of said resilient means when said first pull tab is pulled; and (g) a second pull tab operatively connected to said second tab-operated member for pivotally moving the same, when said second pull tab is pulled, and thus permitting said second tongue to be into engagement with said first tongue, so as to pivotally move said first tab-operated member against the bias of said first resilient means, whereby said locking pawl is retracted away from said guide channel.

2. A slider according to claim 1, wherein each of said first and said second tab-operated members include a pair of rounded shoulders to accommodate said pivotal motion, and wherein said first and said second wings are provided therein with depressions for receiving said pairs of rounded shoulders, respectively.

3. A slider according to claim 1, wherein said first and said second tongues are normally held in contact with respective front walls of said first and said second offset portions of said cross-channel.

4. A slider according to claim 1, further comprising first and second covers fixedly mounted on said first and said second wings for enclosing at least said first and said second tab-operated members, respectively.

5. A slider according to claim 4, said first resilient means including a first leaf spring enclosed in and supported by said first cover.

6. A slider according to claim 5, further comprising second resilient means for biasing said second tab-operated member against said second wing, said second resilient means including a second leaf spring enclosed in and supported by said second cover.

7. In a locking, dual-tab slider for a slide fastnener, having a body in which there is a guide channel for the passage therethrough of rows of fastener elements, and a pair of tab-operated members each pivotably moveable by manipulation of a corresponding tab of the slider, one tab-operated member having a locking pawl that projects into said guide channel to engage fastener elements to lock the slider, and which is retractable from said guide channel to release the slider for movement along the rows of fastener elements, said tab-operated members having respective parts positioned for mutual engagement whereby a given pivotal movement of either tab-operated member produces a retraction of said locking pawl from the guide channel, the improvement which comprises respective surfaces on said tab-operated members and said slider body positioned for wiping abutting contact to accommodate said pivotal movement of the tab-operated members without connection thereof to the slider body.

* * * * *